United States Patent [19]

Lee

[11] 4,254,892

[45] Mar. 10, 1981

[54] VENDING MACHINE SHELF WIDENERS

[76] Inventor: Stuart A. Lee, 715 N. Morton Ave., Morton, Pa. 19070

[21] Appl. No.: 63,758

[22] Filed: Aug. 6, 1979

[51] Int. Cl.[3] ..... G07F 11/06

[52] U.S. Cl. ..... 221/90; 221/242

[58] Field of Search ..... 221/242, 90, 241, 129; 211/135, 186, 149, 150, 153, 134, 170, 175

[56] References Cited

U.S. PATENT DOCUMENTS

| | | | |
|---|---|---|---|
| 3,360,091 | 12/1967 | Baum | 221/242 X |
| 3,437,237 | 4/1969 | Calzaretta | 221/90 |
| 3,643,607 | 2/1972 | MacKenzie | 211/153 X |

*Primary Examiner*—Stanley H. Tollberg
*Attorney, Agent, or Firm*—Robert S. Lipton; Robert B. Famiglio; Arthur E. Oaks

[57] ABSTRACT

A low cost apparatus adapted to permit shelf type vending machines adapted to sell small items such as candy bars to be modified so that larger items such as cakes and pies can be sold therefrom. The apparatus comprises a panel which fits onto a shelf of the machine so as to widen it to accomodate such larger items. Ease of assembly is assured by having the panel engage the shelf with a pair of runners which engage the sides of said shelf and hold it in place with a friction fit.

5 Claims, 5 Drawing Figures

VENDING MACHINE SHELF WIDENERS

BACKGROUND OF THE INVENTION

1. Field of the Invention

This invention relates to vending machines adapted to sell consumer items to the public.

2. Description of the Prior Art

Vending machines adapted to purvey a wide variety of goods are widely used in retail merchandising. One type used to sell such items as candy, ciagarettes, single serving cans, etc., is built so that the goods being sold are stored in a set of vertical columns which often are used to separate the different brands or types of goods in the machine. Within the column, the goods are stacked by being placed onto a multiplicity of locked pivoting platform like members, placed one above the other and adapted to hold a single portion of the goods being sold. In these machines, after the purchaser deposits a sum of coins of the proper value, the mechanism of the machine is enabled so that when the purchaser pulls a lever or pushes a button indicating his particular purchase, one platform, starting at the lowermost position in the stack, is actuated and will unlock. When this happens, the weight of the stored item will cause it to rotate downward around the pivot point so that the goods thereon will drop off the platform down the column into a receiver from which the purchaser removes the goods purchased. Such machines present few problems as long as all the goods are of the same general size such as candy bars and cigarettes. When, however, goods of varying size such as cakes, pies and similar products where some are fairly wide and others are narrow or small are sold, problems arise. If the machine is adapted for all wide products valuable sales volume is lost when narrow products are sold. Similarly, large cakes will simply not fit into a machine adapted for candy bars. What is therefore needed is a machine which can be modified with minimum effort and at low cost to handle both narrow and wide products at the same time.

The subject invention is designed to do this. Briefly, it is a lightweight aluminum or plastic panel adapted to fit over the platforms to provide an adjustable wider support area with a minimum of effort. Because the vertical columns themselves are normally invariable in width the panel is normally designed so that its extra width will protrude into only one of the adjacent columns. To accomodate them in that column it is only necessary to disengage all of the platforms in it so that they either can be rotated out of the way or physically removed. Vending machines of the type described above routinely incorporate one or the other of these options to facilitate maintenance, cleaning and similar operations.

SUMMARY OF THE INVENTION

Accordingly, it is the primary object of this invention to provide adjustment means for easily varying the width of merchandise carrying platforms in vending machines to accomodate goods of different sizes without making significant modifications to the machine.

It is a further object of the invention to provide a low cost, light weight means for making these adjustments.

Additional objects of this invention will become apparent to those versed in the art upon an understanding of the detailed description of the apparatus taken in conjunction with the attached drawings.

BRIEF DESCRIPTION OF THE DRAWINGS

In the drawings, in which like numerals refer to like parts.

DESCRIPTION OF THE PREFERRED EMBODIMENT

Figure 1:
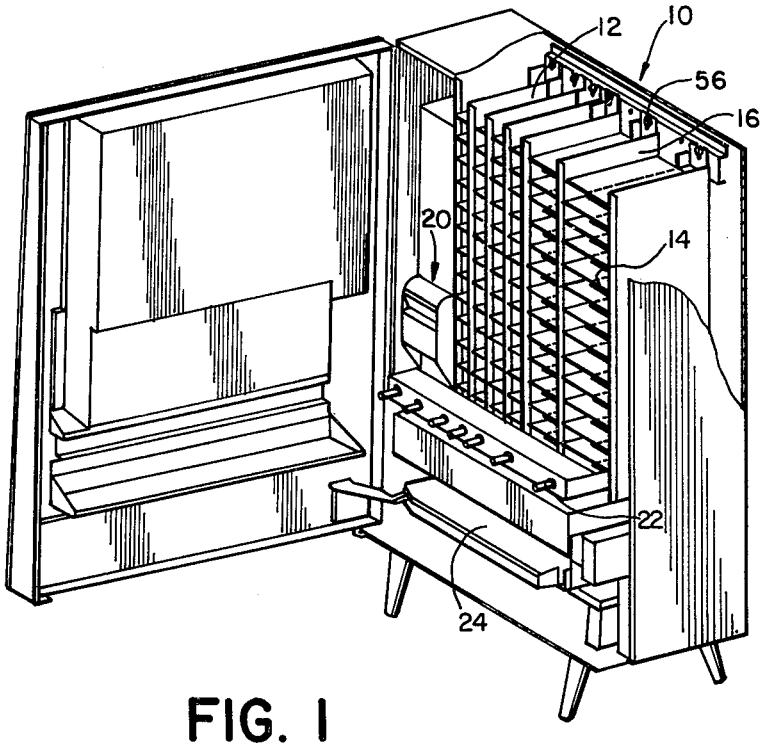
FIG. 1 shows an isometric front elevation view of a vending machine.

Referring now to FIG. 1 we see a view of a vending machine 10 of the type of interest here. As shown the goods are stored in a plurality of vertical columns or channels 12 each of which contains a plurality of platforms or shelves 14 upon which the goods to be sold are placed. Each column is normally separated by a side wall 16 which acts both to channel the goods when they are delivered to a purchaser and to provide plurality of brackets 18 adapted to hold each of said shelves in place. As will hereinafter be explained, the shelves are held, when loaded, in a horizontal position by a locking finger (not shown) in the machine. In use, the machine is actuated whenever a customer inserts the proper amount of money, usually in coin form, into hopper 20. The machine is set to allow the purchaser to receive one item which is selected by pulling one of knobs 22 located at the bottom of each of vertical columns 12. The goods are delivered, one for each sale, starting from the lowermost shelf in the column, to receiver 24 from which they are extracted for use.

Figure 2:
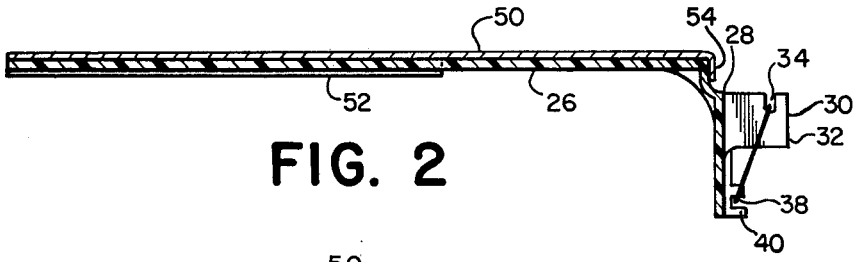
FIG. 2 is a side view of the adjusted platform.
Figure 3:
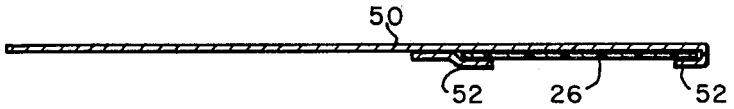
FIG. 3 is an end view of the adjusted platform.
Figure 4:
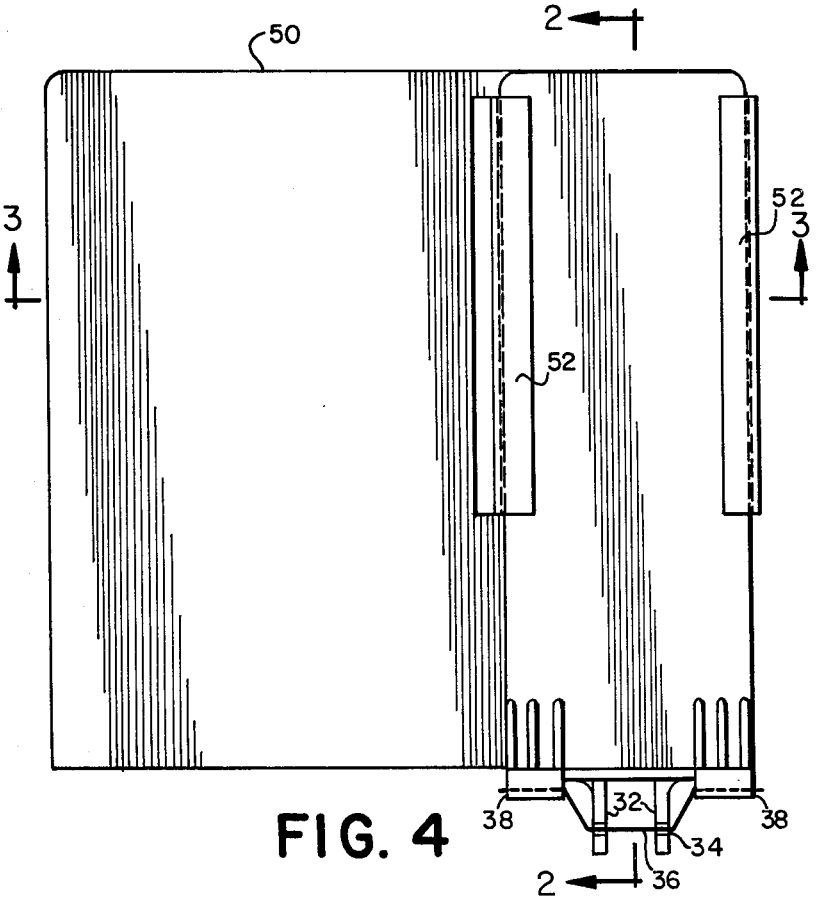
FIG. 4 is a bottom view of the adjusted platform.

The shelf 14 upon which the goods rest is shown in FIGS. 2, 3 and 4. As shown it comprises an elongated platform 26 upon which the goods are placed, a flange 28 located at the rear end of said platform and a locking mechanism 30 located on said flange. The lock comprises a pair of lugs 32 located approximately in the center of said flange and having a groove 34 cut into the shoulders thereof, into which the center portion of lock clip 36 is inserted. This forms a latch which when engaged by a locking finger (not shown) extending from the vending machine will cause the entire shelf to be held in a horizontal position. The two ends 38 of clip 36 after passing through retainers 40 fit into bracket 18 which acts to hold the shelves in their vertical position within the particular column in which they are located.

When a purchase is made and one of knobs 22 pulled, this acts to cause the lowermost engaged locking finger to disengage and release lock 30 of that shelf. The combined weight of platform 26 and the goods on it create a sufficient unbalance to cause the entire shelf to rotate downward around the pivot formed by the ends 38 fitting into bracket 18 so that the item of goods thereon will drop off and fall into the receiver 24 below.

Figure 5:
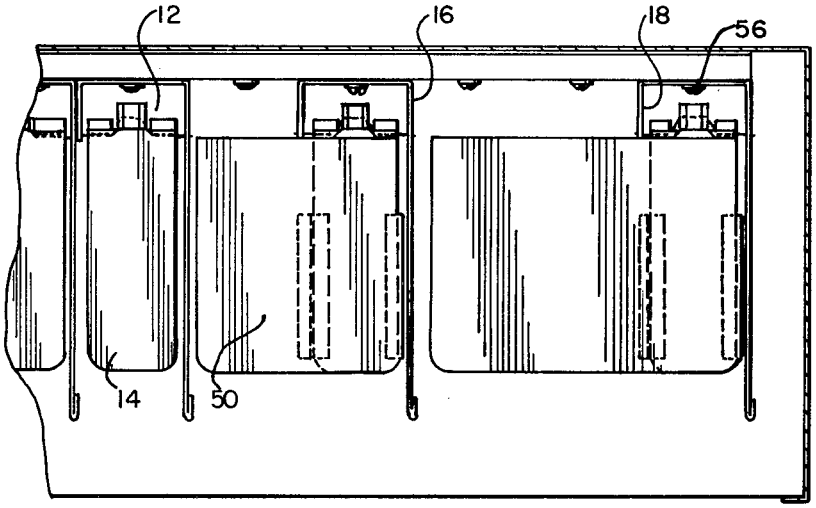
FIG. 5 is a partial top view of the interior of a vending machine showing unadjusted, single and double adjusted platforms in place.

This all works quite satisfactorily as long as the goods sold are essentially all of the same size such as is the case with candy bars, cigarettes and similar items. When, however, goods which are wider than a given vertical channel 12, such as pies or cakes, problems arise. The subject invention is designed to meet them. As shown in FIGS. 2, 3, 4, and 5 it is a flat lightweight panel 50 made of materials such as aluminum or plastic, having a width equal to 2 or 3 of the vertical channels in the vending machine. To fit it onto one of the platforms there are a pair of slide runners 52 on its underside adapted to fit around the side edges of platform 26 so that the panel 50 will fit onto and slide over the surface of platform 26. The fit should be close enough that the panel is effectively locked in place without the need for additional devices such as pins or screws. To reduce sliding friction and the possibility of damaging the platform or panel, it is suggested that the edges of the platform be scalloped to reduce the actual sliding contact points to a much smaller surface area than would be the case with straight sides. As shown the runners 52 are located off center on panel 50. This is to put the additional width into one of the two adjacent channels when it is in use. To do this, however, it is first necessary to remove the interferring vertical wall 16 from between the two adjoining channels. This is relatively simple in most machines since these walls are usually held in place by a few screws 56. When these are removed the vertical wall and the shelves associated with it come out as a single unit. In many cases the locking finger actuating mechanism (not shown) comes out at the same time thus having the effect of disengaging the knob 22 associated with that channel and allowing its easy removal. As shown in FIG. 5, panel 50 can be adapted to fit over two adjacent channels instead of just one. Once the interferring wall and shelves are removed, the panels 50 can easily and quickly be slipped onto the shelves and the machine put back into use with a minimum of effort and time lost.

A second feature of the panel is flange 54 which is located on the forward end of the panel. This is designed to hook over the back end of shelf 26 and acts to prevent panel 50 from sliding off the platform when the assembly rotates downward after a sale. Since the flange prevents sliding the panel directly onto the platform, the forward end must be bent slightly upward to fit over the top surface of the platform as the panel is pushed into position, at which time it snaps into place. This bending is facilitated both by shortening the length of runners 52, as shown in FIG. 4 and making the panel itself out of relatively thin flexible materials. Thus it is apparent with the present invention, a means for quickly, easily and inexpensively adjusting the size of shelves in vending machines so that goods of varying width can be placed therein without changing the basic structure of said vending machine.

The present invention may be embodied in other specific forms without departing form the spirit or essentual attributes thereof and accordingly reference sould be made to the appended claims rather than to the foregoing specifications as indicating the scope of the invention.

What is claimed is:

1. In combination with a vending machine, of the type wherein the goods being sold are stored in a series of vertical columns, arranged so that the individual items of merchandise are placed, one above the other, on a series of locked pivoting shelves which are adapted, whenever a sale is made, to unlock and rotate one at a time, in series starting with the lowermost shelf so that the particular item sold is dropped down the column into a receiver from which the purchaser can remove it, adjustment means adapted to allow a shelf to accept items of merchandise wider than the width of the vertical column in which it is placed without changing the basic function or structure of said vending machine wherein said adjustment means comprises a flat, lightweight panel adapted to engage a shelf and fit over it so that the effective width of the shelf is increased to accomodate larger sized goods and further adapted to non-interferringly rotate with said shelf whenever it is activated by a sale.

2. The panel of claim 1 further adapted to fit onto said shelf such that the extra width will protrude into one or the other of the vertical columns adjacent to the column containing the shelf being widened.

3. The panel of claim 2 further comprising a pair of slide runners on the underside adapted to fit around the edges of the shelf being widened and lock the panel in place on it.

4. The apparatus of claim 3 wherein the shelves of said vending machine have scalloped edges whereby the sliding contact area between the panel and shelf is reduced and ease of engagement increased.

5. The apparatus of claim 2 or 3 wherein said panel further comprises a flange adapted to fit over the end of said shelf whereby the panel is held in place when said panel rotates after a sale is made.

* * * * *